United States Patent [19]

Root et al.

[11] Patent Number: 4,514,312

[45] Date of Patent: Apr. 30, 1985

[54] LUBRICANT COMPOSITIONS COMPRISING A PHOSPHATE ADDITIVE SYSTEM

[75] Inventors: Jon C. Root, Leawood; John F. Barnes, Olathe, both of Kans.; Jack E. Coovert, Kirkwood, Mo.

[73] Assignee: Witco Chemical Corporation, New York, N.Y.

[21] Appl. No.: 599,653

[22] Filed: Apr. 12, 1984

Related U.S. Application Data

[63] Continuation-in-part of Ser. No. 400,728, Jul. 22, 1982, abandoned.

[51] Int. Cl.[3] ..... C10M 1/46

[52] U.S. Cl. ..... 252/32.5; 252/18; 252/25; 252/49.8; 252/49.9

[58] Field of Search ..... 252/18, 25, 32.5, 49.8, 252/49.9

[56] References Cited

U.S. PATENT DOCUMENTS

| | | | |
|---|---|---|---|
| 3,720,612 | 3/1973 | Bosniack et al. | 252/32.5 |
| 4,107,058 | 8/1978 | Clarke et al. | 252/18 |
| 4,305,831 | 12/1981 | Johnson et al. | 252/18 |

OTHER PUBLICATIONS

Lubricant Additives by Smalheer et al., 1967, The Lezius-Hiles Co., p. 10.

*Primary Examiner*—Jacqueline V. Howard
*Attorney, Agent, or Firm*—Wallenstein, Wagner, Hattis, Strampel & Aubel

[57] ABSTRACT

A lubricant composition having special utility as a lubricant in constant velocity universal joints of the type used in front wheel drive vehicles. The composition comprises a low sulfur lubricating oil base grease and an additive package comprising a mixture of an oil soluble, sulfur-free organic compound and an oil insoluble sulfur-free inorganic compound.

15 Claims, No Drawings

LUBRICANT COMPOSITIONS COMPRISING A PHOSPHATE ADDITIVE SYSTEM

This application is a continuation-in-part application of U.S. patent application Ser. No. 400,728, filed July 22, 1982, now abandoned.

FIELD OF THE INVENTION

This invention relates to improved lubricant compositions having special utility as extreme pressure and antiwear lubricants for constant velocity universal joints such as are used in front wheel drive vehicles.

BACKGROUND OF THE INVENTION

The utilization in automotive vehicles of greases having extreme pressure, antiwear and high temperature properties has resulted in the publication by manufacturers of automotive vehicles of special specifications which must be satisfied by such greases. Thus, in the case of a grease to be used as a lubricant in constant velocity universal joints of the type used in front wheel drive vehicles, the grease must not only have extreme pressure and high temperature performance capabilities due to the proximity of the universal joints to the heat generating exhaust components of the vehicle, but, also, the grease must not attack or cause any appreciable deterioration of the elastomeric material of which the boots or seals used in the universal joints are fabricated. The attack or deterioration of the seals, which usually are formed of silicone based elastomers, may involve a change in hardness, tensile strength, elongation or volume of the seals any, or all of which changes can result in the breakdown, or at least the malfunctioning of the seals.

DESCRIPTION OF THE INVENTION

In accordance with the present invention, unique lubricant compositions have been evolved which, while having general utility as extreme pressure and antiwear greases, have special utility as extreme pressure and antiwear greases for use as lubricants in the constant velocity universal joints of front wheel drive motor vehicles. In addition to their excellent extreme pressure performance capabilities, the lubricant compositions of this invention retain their lubricating and antiwear properties at elevated temperatures even under conditions of prolonged or continuous use. When the compositions are employed as lubricants in constant velocity universal joints of motor vehicles, the elastomeric seals used in the joints do not manifest any deleterious change in physical properties, and, as a result, neither the function performed by the seals nor their useful life is in any way adversely affected.

The lubricant compositions of this invention, in brief, comprise a major proportion of a lubricating oil base grease, especially a low sulfur lubricating oil base grease, and a minor proportion of an additive system consisting essentially of a mixture of an oil soluble, sulfur-free organic compound and an oil insoluble, sulfur-free inorganic compound, the additive system being present in an amount sufficient to impart extreme pressure and antiwear properties to the lubricant compositions. The components of the additive system may be complemented by the addition of small amounts of an antioxidant and a corrosion inhibiting agent, as well as dyes and pigments to impart a desired color to the compositions.

The lubricating oil base grease employed in the preparation of the lubricant compositions of this invention can be any of various oil base greases employed in the formulation of extreme pressure greases. Exemplary of such greases are the mono- and polyurea thickened grease compositions disclosed in U.S. Pat. Nos. 3,243,372; 3,846,314 and 4,065,395. The base oils employed in the preparation of such greases can comprise hydrocarbon mineral oils derived from petroleum, synthetic hydrocarbon oils, and polysiloxanes. Especially preferred base greases are those employing a low sulfur petroleum derived mineral oil thickened with a di-, tri-, or tetraurea, or mixtures thereof. Generally speaking, these preferred base oils having a sulfur content of less than 2%, preferably less than 1%, and most preferably less than 0.1%, by weight, and are characterized by the absence of agents which may be corrosive, or which may attack elastomers, particularly silicone elastomers. Other, but less preferred base greases which can be used are metal soap-thickened mineral oil base greases such as lithium stearate and lithium hydroxy stearate greases, sodium stearate greases, and the like. In this same category are base greases such as soap thickened synthetic hydrocarbon oils and synthetic ester oils exemplified by alkyl benzenes, silicone oils, and esters of dibasic acids. Yet another group of base greases which can be used are clay thickened greases including bentonite and attapulgite thickened greases, as well as silica gel greases and barium greases.

The oil insoluble, sulfur-free inorganic compound component of the additive system employed in the formulation of the lubricant compositions of the present invention can be any of the oil insoluble alkali metal or alkaline earth metal salts of a phosphorus acid, and mixtures thereof. The alkali metal phosphate salts useful in the practice of the invention include lithium phosphate, potassium phosphate, sodium phosphate and cesium phosphate. Among the alkaline earth metal phosphate salts which can be used are monocalcium phosphate, dicalcium phosphate, strontium phosphate, barium phosphate or magnesium phosphate. Other sulfur-free metal salts of a phosphorus acid which can be employed include aluminum phosphate, cadmium phosphate and zinc phosphate. The preferred metal phosphate salts are monocalcium phosphate and dicalcium phosphate, and mixtures thereof. The metal phosphate salts advantageously are utilized in pulverulent, or powder-like form. The particle size of the metal phosphate salts used desirably should range in size from less than 1 micron to about 30 or 40 microns, more or less.

The oil soluble, sulfur-free organic compound moiety of the additive system used in the lubricant compositions advantageously is selected from the group consisting of oil soluble, sulfur-free organic phosphates and phosphites. Included in this group are alkyl, aryl, and alkyl aryl phosphates or phosphites, specific examples of which are triethyl phosphate, tri (n-propyl) phosphate, tributyl phosphate, diisopropyl hydrogen phosphite, tricresyl phosphate, triphenyl phosphate, cresyl diphenyl phosphate, p-tert-butylphenyl diphenyl phosphate, tris (2-biphenyl) phosphate, 2-ethylhexyl diphenyl phosphate, isooctyl diphenyl phosphate, triethyl phosphate, tributyl phosphate, tri (n-propyl) phosphate, to mention a few. An especially preferred sulfur-free organic phosphate is an aromatic amine phosphate sold under the trade designation "VANLUBE 692" (R. T. Vanderbilt Company, Inc.). This phosphate has a complex chemical structure, and is characterized in that it is a viscous liquid (190 SUS at 100° C.) which is soluble in low sulfur petroleum oils. It is further characterized in that it has a density of 0.99 mg/m$^3$ and a flash point of 310° F. A related product, "VANLUBE 672", also can be used. "VANLUBE 672", like "VANLUBE 692" is an amine phosphate, but differs from the latter in that it has a density of 1.05 mg/m$^3$, a viscosity of 790 SUS at 100° C., and a flash point of 240° F.

The ratio of sulfur-free inorganic compound to sulfur-free organic compound employed in the formulation of the lubricant compositions is somewhat variable. However, the generally optimum objectives of the invention are obtained with sulfur-free inorganic compound to sulfur-free organic compound ratios of the order of about 8:1, especially desirably about 5:1 to about 7:1. The proportion of the additive system incorporated in the base grease can range from about 1% to about 40%, by weight of the lubricant compositions, with a preferred range of from about 5% to about 20%, and most preferably from about 10% to 15%, by weight of the lubricant compositions.

As indicated above, additional additives may be incorporated into the compositions to enhance and augment their properties. Included among such additives are various antioxidants exemplary of which are 2,6-di-tert-butyl-α-dimethyl amino-p-cresol, 4,4'-methylene bis (2,6-di-tert-butylphenol). Products of this type are available commercially under the trade designations "ETHYL" ANTIOXIDANT "702" AND "703" (ETHYL Corporation). Specific examples of other antioxidants which can be used are p,p'-dioctyldiphenylamine, polymerized 1,2-dihydro-2,2,4-trimethylquinoline, and 2,6-ditertiary-butyl-p-cresol. Products of this type are available commercially under the trade designations "VANLUBE 81" and "VANLUBE RD" (R. T. Vanderbilt Company, Inc.). The proportions of the antioxidants used in the formulation of the lubricant compositions may range from about 0.5% to about 2.5%, usually from about 0.8% to about 1.5%, by weight, of the compositions.

A corrosion inhibitor also can be used as an additive to enhance the overall properties of the compositions. Any of various inhibitors, especially ferrous iron corrosion preventatives, can be employed. Sodium nitrate is a preferred member of this group. The amount of inhibitor added to the compositions can range from about 0.25% to about 1.5% by weight of the composition.

Dyes such as ethyl green, ethyl blue, eosin and toluene blue, and pigments exemplified by titanium dioxide, zinc oxide, carbon black, and mixtures of such dyes and pigments may, if desired, be incorporated into the compositions to impart coloring characteristic to the compositions which conform to the color of standard grease products. When used, the colorants will generally comprise anywhere from about 0.001% to about 5%, by weight of the compositions.

By way of illustration, and to demonstrate the effectiveness of the lubricant compositions as extreme pressure greases the following tests were carried out.

EXAMPLE I

A polyurea thickened grease base is prepared by charging to a grease kettle approximately 35 weight percent of a sulfur free solvent extract neutral base oil having a viscosity of 600 SUS at 100° F, approximately 2 weight percent p-toluidine, and approximately 12 weight percent of a mixture of oleyl amine and ethylene diamine, the oleyl amine comprising approximately 11 weight percent of the mixture. The resulting composition is stirred and heated to a temperature of approximately 83° C. to dissolve the amines in the base oil. In a separate vessel, approximately 6 weight percent of 2,4-toluene diisocyanate is mixed with a remaining portion, approximately 34 weight percent, of the base oil. This mixture is added at a controlled flow rate to the amine-base oil composition in the grease kettle so as not to permit the bulk temperature of the composition to exceed 120° C. After all of the diisocyanate solution is added, the grease composition is stirred with heat at a temperature of approximately 190° C. for 30 minutes. The grease composition is then cooled, and an additive package comprising 8 weight percent dicalcium phosphate, 1 weight percent monocalcium phosphate, 1 weight percent "ETHYL 703" (antioxidant) and 2 weight percent "Vanlube 692" (aromatic amine phosphate) is stirred into the grease base. The resulting composition is milled through a colloid mill at a clearance of 0.002 inch, and then tested as an extreme pressure lubricant for use in constant velocity universal joints of motor vehicles. The test data is tabulated below:

| Test | Results |
|---|---|
| Worked penetration at 60 strokes ASTM D-217 | 290 |
| Dropping point - modified ASTM D-2265 | 472° F. |
| Timken load - ASTM D-2509 (lbs. passed) | 60 |
| Four Ball Wear 50 kg, 1800 RPM - ASTM D-2266 | 0.45 mm |
| Copper corrosion at 350° F. | 1a |
| Unworked penetration at −18° F. | 158 |
| Fretting (Andrews Bearings, 25# torque) | |
| (a) room temp. | 4.8 mg/section |
| (b) 0° F. | 6.1 mg/section |
| Bleed % - SSG Cone test - SDM-433 | — |
| Elastomer compatibility at 72 hrs. | |
| 1. change in hardness | −9 |
| 2. Change in volume (%) | 8.87 |
| 3. elasticity (lbs.) | 54.3 |
| 4. distance stretched (in.) | 5.89 |

The foregoing test results meet all the product specifications (No. 7836943) established by General Motors Corporation for a lubricant for use in the constant velocity universal joints of its front wheel drive vehicles.

EXAMPLE II

A base grease is prepared as in Example I. An additive package comprising 12 weight percent dicalcium phosphate, 1 weight percent ETHYL 703 and 2 weight percent "VANLUBE 692" is incorporated in the base grease as in Example I, and tested as a lubricant for use in constant velocity universal joints. The test results are as follows:

| Test | Results |
|---|---|
| Worked penetration at 60 strokes - ASTM D-217 | 291 |
| Dropping point - modified ASTM D-2265 | 464° F. |
| Timken load - ASTM D-2509 (lbs. passed) | 50 |
| Four Ball Wear 50 kg, 1800 RPM - ASTM D-2266 | 0.48 mm |
| Copper corrosion at 350° F. | 1a |
| Unworked penetration at −18° F. | 164 |
| Fretting (Andrews Bearings 25# torque) | |
| (a) room temp. | 11.30 mg/section |
| (b) 0° F. | 27.75 mg/section |
| Bleed % - SSG Cone test - SDM-433 | 1.4 |
| Elastomer compatibility at 72 hrs. | |

-continued

| Test | Results |
|---|---|
| 1. change in hardness | −9.7 |
| 2. change in volume (%) | 8.56 |
| 3. elasticity (lbs.) | 50 |
| 4. distance stretched (in.) | 5.4 |

EXAMPLE III

A polyurea thickened grease is prepared by charging to a grease kettle about 30 weight percent of a solvent extracted neutral base oil containing less than 0.1% by weight sulfur and having a viscosity of 600 SUS at 100° F, and 7.46 weight percent of primary oleyl amine. In a separate vessel, approximately 5.4 weight percent of an isocyanate (143 L-MDI, Upjohn) is mixed with a remaining portion, approximately 35 weight percent, of the base oil. The latter mixture is added at a controlled flow rate to the primary amine-base oil mixture in the grease kettle so as not to permit the bulk temperature of the mixture to exceed 50° C. After all of the isocyanate solution is added, the resulting mixture is stirred for 30 to 60 minutes. Water, at approximately 3 weight percent, is then added, and mixed in for 20 to 30 minutes. The mixture thereafter is tested for free isocyanate and amine, and adjusted to remove any excess. Approximately 3.5 weight of calcium hydroxide is then mixed into the polyurea blend, followed by the slow addition of approximately 6 weight percent phosphoric acid (85%). Approximately 0.1 weight percent of "Vanlube 692" is then added, and the mixture is heated to approximately 175° C. for 30 minutes. The resultant mixture is cooled with a remaining portion (approximately 10 weight percent) of the base oil to ambient temperature. The composition is then milled through a colloid mill at a clearance of 0.002 inch, and tested as an extreme pressure lubricant for use in constant velocity universal joints of a front wheel drive vehicle. The test data is set out below:

| Test Results | |
|---|---|
| Worked penetration at 60 strokes - ASTM D-217 | 302 |
| Dropping point - modified ASTM D-2265 | 480° F. |
| Timken load - ASTM D-2509 (lbs. passed) | 55 |
| Four Ball Wear 50 kg, 1800 RPM - ASTM D-2266 | 0.50 mm |
| Copper corrosion at 350° F. | 1a |
| Unworked penetration at −18° F. | 160 |
| Fretting (Andrews Bearings 25# torque) | |
| (a) room temp. | 10.80 mg/section |
| (b) 0° F. | 29.45 mg/section |
| Bleed % - SSG Cone test - SDM-433 | 2.05% |
| Elastomer compatibility at 72 hrs. | |
| 1. change in hardness | −9.85 |
| 2. change in volume (%) | 8.40 |
| 3. elasticity (lbs.) | 56 |
| 4. distance stretched (in.) | 7.0 |

What is claimed is:

1. A lubricant composition for use under extreme pressure conditions while being substantially inert with respect to elastomeric substances over a wide temperature range, comprising: a major proportion of a low-sulfur lubricating oil base grease, and a minor proportion of an additive system consisting essentially of a mixture of an oil-soluble, sulfur-free organic phosphate or phosphite and one or more oil-insoluble, sulfur-free inorganic phosphates, said additive system being present in an amount sufficient to impart extreme pressure properties to the lubricant composition, while at the same time being substantially inert with respect to elastomeric substances with which the lubricant composition may come into contact.

2. A lubricant composition according to claim 1 wherein the lubricating oil base grease contains a mono- or polyurea, or a mixture thereof, as a thickening agent.

3. A lubricant composition according to claim 1 wherein the sulfur-free organic phosphate is an alkyl, aryl or alkylaryl phosphate or phosphite.

4. A lubricant composition according to claim 1 wherein the sulfur-free organic phosphate is an aromatic amine phosphate.

5. A lubricant composition according to claim 1 wherein the sulfur-free inorganic phosphate is an alkali or alkaline earth metal phosphate.

6. A lubricant composition according to claim 1 wherein the ratio of sulfur-free inorganic phosphate or phosphite to sulfur-free organic phosphate in the additive system is from about 1:8.

7. A lubricant composition according to claim 1 wherein the sulfur-free inorganic phosphate moiety of the additive system comprises a mixture of dicalcium phosphate and monocalcium phosphate.

8. A lubricant composition according to claim 1 wherein the additive system comprises from about 1% to about 40% by weight of the composition.

9. A lubricant composition according to claim 1 wherein an antioxidant is incorporated in the composition.

10. A lubricant composition according to claim 1 wherein the composition contains a minor amount of a corrosion inhibitor.

11. A lubricant composition according to claim 1 wherein the sulfur-free inorganic phosphate is dicalcium phosphate.

12. A lubricant composition according to claim 9 wherein the antioxidant is 2,6-di-tert-butyl-dimethylamine-p-cresol or 4,4'-methylene bis (2,6-di-tert-butylphenol) or butylated hydroxytoluene.

13. A lubricant composition according to claim 10 wherein the corrosion inhibitor is sodium nitrate.

14. A lubricant composition according to claim 1 wherein the additive system comprises from 10% to about 15% by weight of the composition.

15. A lubricant composition according to claim 1 wherein the lubricating oil base grease contains less than 1% by weight of sulfur.

* * * * *